US006623112B2

(12) United States Patent
Yamada et al.

(10) Patent No.: US 6,623,112 B2
(45) Date of Patent: Sep. 23, 2003

(54) CONTROL DEVICE CONTROLLING DEFLECTION AMOUNT BY REDISTRIBUTING CHARGE WITHIN INK DROPLET DURING FLIGHT

(75) Inventors: Takahiro Yamada, Hitachinaka (JP); Kunio Satou, Hitachinaka (JP); Shinya Kobayashi, Hitachinaka (JP); Hitoshi Kida, Hitachinaka (JP); Lee Chahn, Hitachi (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/231,200

(22) Filed: Aug. 30, 2002

(65) Prior Publication Data

US 2003/0043239 A1 Mar. 6, 2003

(30) Foreign Application Priority Data

Aug. 31, 2001 (JP) ..... 2001-263200

(51) Int. Cl.[7] ..... B41J 2/02
(52) U.S. Cl. ..... 347/74; 347/77
(58) Field of Search ..... 347/74, 75, 76, 347/77, 82

(56) References Cited

U.S. PATENT DOCUMENTS 3,689,936 A * 9/1972 Dunlavey ..... 347/82
3,898,671 A * 8/1975 Berry et al. ..... 347/76
4,281,333 A * 7/1981 Tsuzuki et al. ..... 347/74
6,357,866 B1 * 3/2002 van Rensburg ..... 347/75

FOREIGN PATENT DOCUMENTS

JP 47-7847 3/1972

* cited by examiner

*Primary Examiner*—Anh T. N. Vo
*Assistant Examiner*—Osmalls Logan
(74) *Attorney, Agent, or Firm*—Witham, Curtis & Christofferson, P.C.

(57) ABSTRACT

As shown in FIG. 7(*e*), an electric field is generated at timing T3 at which an ink droplet 14 is divided, end moves the negative ions toward a main ink portion 14*m*. As shown in FIG. 7(*e*'), a resultant main ink droplet 14M has an increased charging amount of −3 q, and a satellite ink droplet 14S has a decreased charging amount of −6 q. When the main ink droplet 14M and the satellite ink droplet 14S have the mass of 1 m and Qs, respectively, then the relative charging amounts of the main ink droplet 14M and the satellite ink droplet 14S are both −3. Hence, the deflection amount of the satellite ink droplet 14S is approximately equal to the deflection amount of the main ink droplet 14M. Accordingly, the satellite ink droplet 14S and the rain ink droplet 14M impact the recording sheet 60 on the same spot or on the extremely close spots, thereby forming a single dot.

19 Claims, 9 Drawing Sheets

FIG.5(a)
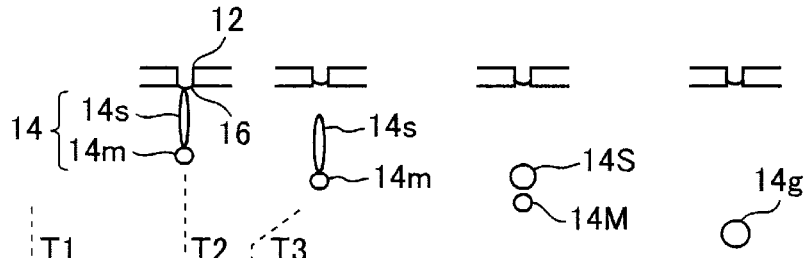
FIG.5(b)
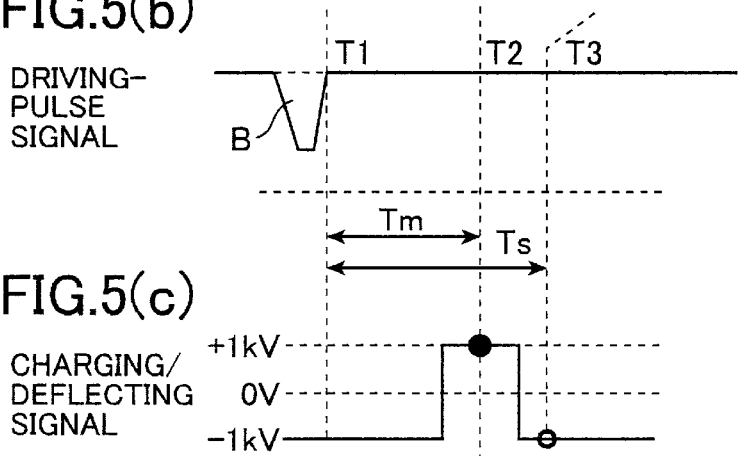
FIG.5(c)
FIG.5(d)
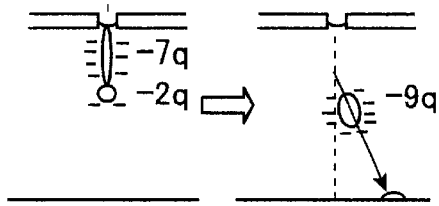
FIG.5(e)
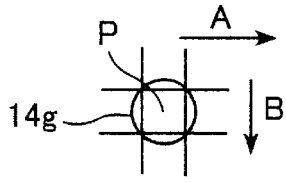

FIG.6(a)
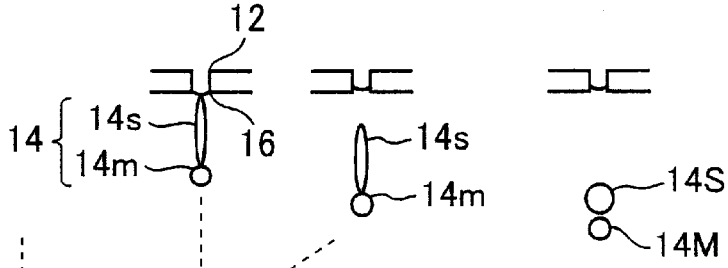
FIG.6(b)
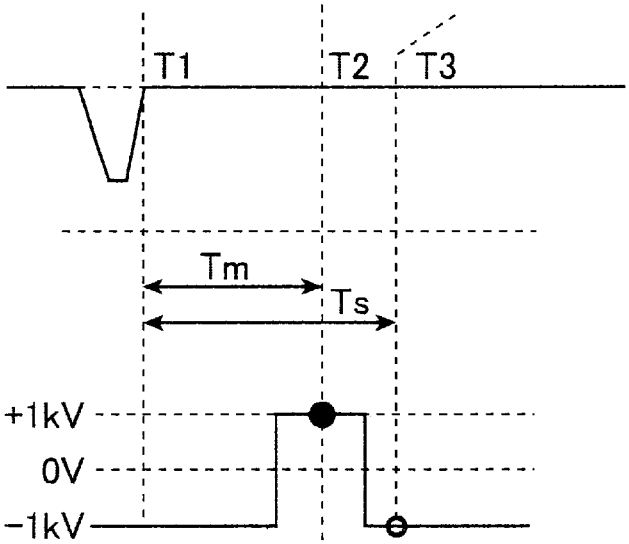
FIG.6(c)
FIG.6(d)
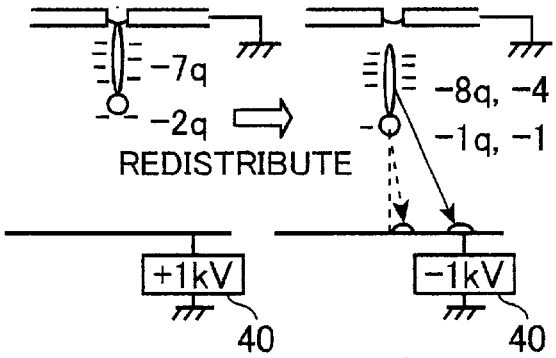
FIG.6(e)
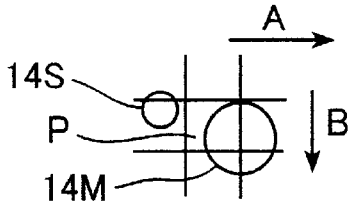

16
14s
14m
14S
14M

DRIVING-PULSE SIGNAL
T1
T2
T3
Tm
Ts

CHARGING/DEFLECTING SIGNAL
+1kV
0V
-1kV

CHARGING/DEFLECTING SIGNAL
+1kV
0V
-1kV

CHARGING/DEFLECTING SIGNAL
+1kV
0V
-1kV

CHARGING/DEFLECTING SIGNAL
+1kV
0V
-1kV
FIG.7(c')
-7q
-2q
-8q, -4
-1q, -1
FIG.7(d')
-7q
-2q
-6.5q, -3.25
-2.5q, -2.5
FIG.7(e')
-7q
-2q
-6q, -3
-3q, -3
FIG.7(f')
-7q
-2q
-5.5q, -2.75
-3.5q, -3.5

DRIVING-PULSE SIGNAL
T1
T2
T3
T4
T5
T6
B
B2
Tm
Ts
Tm
Ts

CHARGING/ DEFLECTING SIGNAL
+1kV
0V
−1kV

CHARGING/ DEFLECTING SIGNAL
+1kV
0V
−1kV

CHARGING/ DEFLECTING SIGNAL
+1kV
0V
−1kV

CHARGING/ DEFLECTING SIGNAL
+1kV
0V
−1kV

CONTROL DEVICE CONTROLLING DEFLECTION AMOUNT BY REDISTRIBUTING CHARGE WITHIN INK DROPLET DURING FLIGHT

BACKGROUND OF THE INVENTION

1. Field of the Invention

The present invention relates to a control device enabling an inkjet printer to reliably provide high-quality images at a high printing speed.

2. Related Art

There has been proposed a line scanning typo inkjet printer capable of printing images on an elongated uncut recording sheet at a high printing speed. This type of printer includes a head that is formed with a plurality of nozzles and has an elongated width covering across the entire width of the recording sheet. When printing images, ink droplets are ejected from the nozzles based on recording signals onto the recording sheet that is being fed at a high speed in its longitudinal direction. By controlling both the ink ejection and the feed of the recording sheet, a desired image is obtained on the recording sheet.

There are two types of line scanning type inkjet printer. One includes a continuous inkjet head, and the other includes an on-demand inkjet head. Although the printer with the on-demand inkjet head is slow in printing speed compared to the printer with the continuous inkjet head, the on-demand inkjet head requires a simple ink system, and so is well suited for general-purpose high-speed printers.

An on-demand inkjet head of a line-scanning type inkjet printer is formed with a plurality of nozzle lines, each including a plurality of nozzles aligned in a line. Each of the nozzles is formed with an ink chamber and provided with an energy generating member, such as a piezoelectric element or a heat generating element. Upon applied with a driving voltage, the energy generating member applies a positive pressure to ink in the ink chamber, so that some of the ink is ejected as an ink droplet through a nozzle hole.

There has been proposed an inkjet printer that includes the above-described on-demand inkjet head and, in addition, charger/deflector mechanism, which charges an ink droplet ejected from the nozzle and also generates a deflector electric field that deflects the charged ink droplet in flight so that the deflected ink droplet will alight (impact) a desired position on the recording sheet In this type of inkjet printer, a plurality of ink droplets ejected from different nozzles can be controlled to alight the same single spot on the recording sheet in order to form a single dot thereon. Because each dot on the recording sheet is formed from a plurality of ink droplets from different nozzles, even if one or more of the different nozzles become defective, the dot is still formed by the reining nozzle(s), whereby images can be formed reliably Also, because each dot is formed by a plurality of different nozzles, bands of darker or lighter gray tones and lines on the printed image due to uneven characteristics among the plurality of nozzles can be canceled out, and so a high quality image, without uneven color density or a white line across the page, can be provided.

Japanese Patent Publication (Kokoku) No. SHO-47-7847 also discloses an ink-droplet deflecting theory for deflecting ink droplets using a charging-amount control method. That is, ink droplets ejected from nozzles are charged based on recording signals, and the charged ink droplets fly through an electro-static field, which deflects the charged ink droplets. The deflection amount depends on the charging amount of the ink droplets. Because it is possible to deflect ink droplets ejected even at a high frequency, this method is well suited for a high-speed printing.

SUMMARY OF THE INVENTION

However, when ink ejection is performed in a two-droplet mode where an ejected ink droplet is separated into a main ink droplet and a satellite ink droplet during the flight before reaching the recording sheet, deflection amounts of the main ink droplet and the satellite ink droplet will defer, whereby the impact position of the main ink droplet will defer from that of the satellite ink droplet. In this case, a single dot is not properly formed on the recording sheet, but undesirable two separate dots are formed, resulting in degradation in overall image quality.

In order to overcome the above problems, it is necessary to perform ink ejection in a single-droplet mode where the ejected ink droplet is not separated during the flight or even it separated, a main ink droplet and a satellite ink droplet merge into a single ink droplet immediately after the separation. Here, the ink ejection performance will be leas influenced by the environmental factors when the ink ejection speed is set higher. Therefore, it is preferable to set the ejection speed relatively high in order to prevent environmental factors from affecting the ink ejection performance. However, although it is relatively easy to achieve the single-droplet mode with a relatively slow ink ejection speed, when the ejection speed is high, then main and satellite ink droplets will not merge easily, resulting in undesirable two-droplets mode.

In this manner, ink ejection speed affect the droplet mode, i.e, either the single mode or the plural mode, such as the two-droplet mode. In addition, the droplet mode also depends on other factors, such as a nozzle type, an ink type, an ink temperature, and the like For example, when ambient temperature changes, ink properties, such as viscosity and surface tension, also change even when other factors or parameters, such as the nozzle properties and ink type, are unchanged When the ink properties change, then the droplet mode may also change, so that an ink ejection speed range within which the single droplet mode can be achieved may change. For example, even when a device can achieve the single droplet mode at the room temperature, the device may be able to achieve only the two-droplet mode at a higher or lower temperature oven if any other parameters are unchanged. Because the effective ink ejection speed range is limited even with the uniform nozzle properties and a single type of ink, when nozzle properties varies and/or a variety of inks is used, then the effective Ink ejection speed range will be limited even more. In fact, it is difficult to make all the nozzles to have the uniform properties, and various types of inks are used in actual printing. Hence, an operational tolerance level of the device designed for a single-droplet mode only is undesirably limited.

It is an object of the present invention to overcome the above problems and also to provide a control device that realizes a highly-reliable inkjet printer capable of printing high quality images at a high speed with a high operational tolerance level even in the two-droplet mode.

In order to achieve the above and other objects, there is provided a control device used in combination with an ejection unit that ejects an ink droplet toward a recording medium, wherein the ink droplet is divided into a plurality of sub-droplets during flight before reaching the recording medium. The control device includes an electric field generating unit that generates a first electric field that redistributes charge within an ink droplet before the ink droplet is divided into a plurality of sub-ink droplets.

There is also provided an inkjet printer including an ejection unit that ejects an ink droplet toward a recording medium, wherein the ink droplet is divided into a plurality of sub-droplets during flight before reaching the recording medium, and an electric field generating unit that generates a first electric field that redistributes charge within the ink droplet before the ink droplet is divided.

Further, there in provided a control method of controlling impact position of sub-droplets. The control method comprises the steps of a) ejecting an electrically charged ink droplet, b) redistributing charge within the charged ink droplet before the charged ink droplet is divided into a plurality of sub-droplets, and C) deflecting the plurality of sub-droplets.

BRIEF DESCRIPTION OF THE DRAWINGS

In the drawings:

FIG. 5(*a*) is plan view or an ink droplet during flight according to a mingle-droplet mode;

FIG. 5(*b*) shows a driving-pulse signal applied to a piezoelectric element;

FIG. 5(*c*) shows a charging/deflecting signal applied to a back electrode;

FIG. 5(*d*) is shows distribution of charge within the ink droplet of FIG. 5(*a*);

FIG. 5(*e*) is an explanatory plan view showing a dot formed on a recording sheet with the ink droplet of FIG. 5(*a*);

FIG. 6(*a*) is plan view of an ink droplet during flight according to a two-droplet mode;

FIG. 6(*b*) shows a driving-pulse signal applied to the piezoelectric element;

FIG. 6(*c*) shows a conventional charging/deflecting signal;

FIG. 6(*d*) is shows conventional redistribution of charge within an ink droplet;

FIG. 6(*e*) is an explanatory view showing dots formed in two-droplet mode with the ink droplet of FIG. 6(*d*);

FIG. 7(*b*) show* the same driving-pulse signal as FIG. 6(*b*);

FIG. 7(*c*) shows the same charging/deflecting signal as FIG. 6(*c*);

FIG. 7(*c*') shows the same redistribution as FIG. 6(*d*);

FIG. 7(*d*) shows a first example of charging/deflecting signal according to the first embodiment of the present invention;

FIG. 7(*d*') is shows redistribution of charge within an ink droplet according to the first example;

FIG. 7(*e*) shows a second example of charging/deflecting signal according to the first embodiment of the present invention;

FIG. 7(*e*') shows redistribution of charge within can ink droplet according to the second example;

FIG. 7(*f*) shows a third example of a charging/deflecting signal according to the first embodiment of the present invention;

FIG. 7(*f*') is shows redistribution of charge within an ink droplet according to the third example;

FIG. 8(*b*) shows the charging/deflecting signal of the first example shown in FIG. 7(*d*);

FIG. 8(*c*) shows the charging/deflecting signal of the second example shown in FIG. 7(*e*);

FIG. 8(*d*) shows a charging/deflecting signal according to a modification of the first example;

FIG. 8(*e*) shows a charging/deflecting signal according to a modification of the second example;

FIG. 10(*b*) shows a driving-pulse signal; and

FIG. 10(*c*) shows a charging/deflecting signal generated by the control device according to the second embodiment of the present invention.

PREFERRED EMBODIMENTS OF THE PRESENT INVENTION

Next, preferred embodiments of the present invention will be described while referring to the attached drawings.

Figure 1:
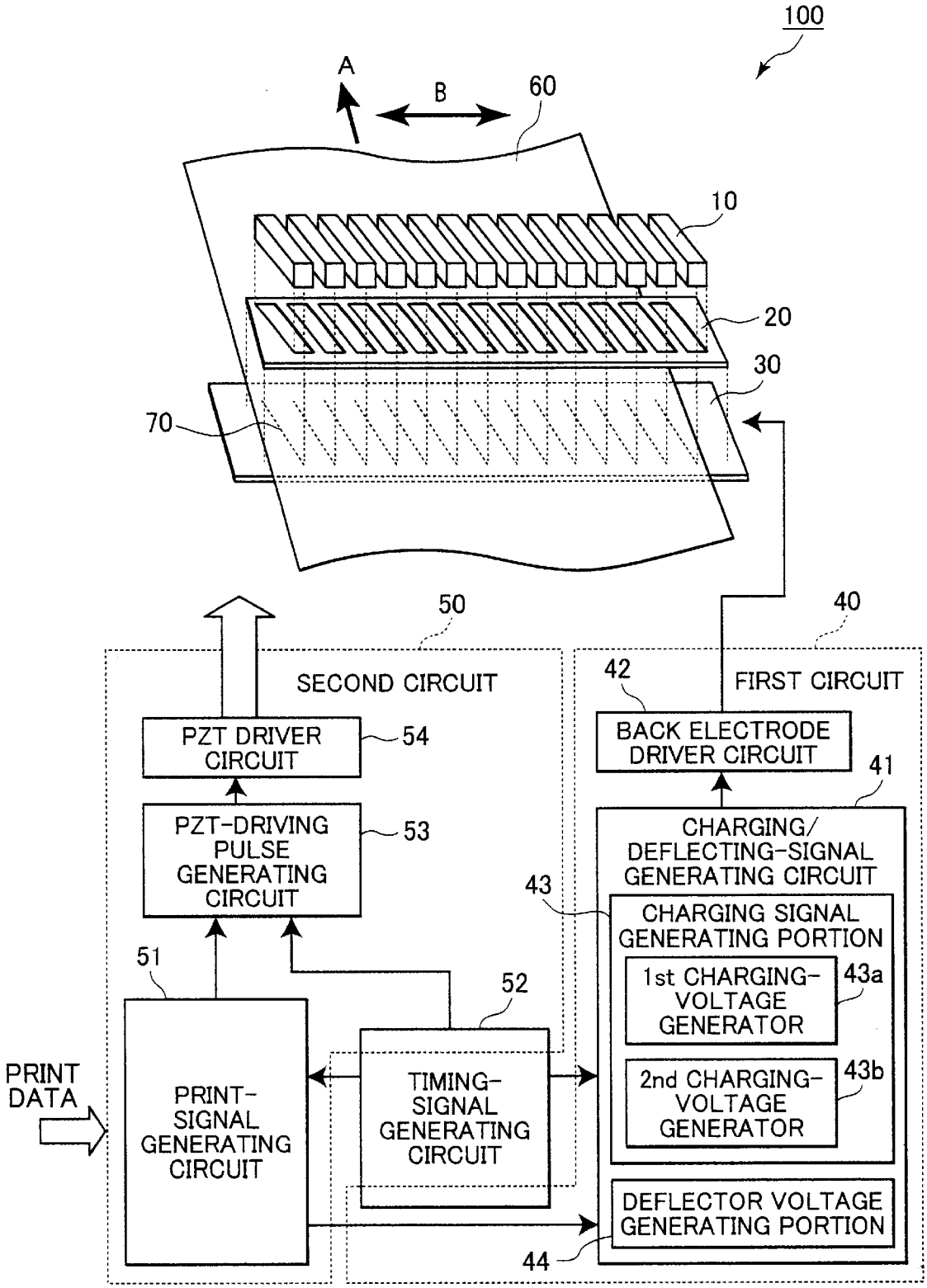
FIG. 1 is a plan view of main components, partially indicated in a block diagram, of an inkjet printer including a control device according to a first embodiment of the present invention.

FIG. 1 shows an overall configuration of an on-demand inkjet printer 100 including a control device according to a first embodiment or the present invention. As shown in FIG. 1, the inkjet printer 100 includes a plurality of head modules 10, a head module mounting member 20, a back electrode 30, a first circuit 40 and a second circuit 50. Although not shown in the drawings, there is also provided a sheet feed mechanism for feeding a recording sheet 60 in a sheet feed direction indicated by an arrow A.

The head module mounting member 20 mounts the plurality of head modules 10. The back electrode 30 is positioned behind the recording sheet 60 such that the back electrode 30 confronts the head module mounting member 20 with the recording sheet 60 interposed therebetween. In other words, a pathway of the recording sheet 60 is defined between the back electrode 30 and the head module mounting member 20.

The second circuit 50 includes a print-signal generating circuit 51, a timing-signal generating circuit 52, a PZT-driving-pule generating circuit 53, and a PZT driver circuit 54. The timing-signal generating circuit 52 generates timing signals and outputs the same to the print-signal-generating circuit 51, the PZT-driving-pulse generating circuit 53, and a charging/deflecting-signal generating circuit 41 (described later) of the first circuit 40. The print-signal generating circuit 51 generates a print-control signal based on the timing signal and on print data input from an external device (not shown), and input the print-control signal to the charging/deflecting-signal generating circuit 41 and the PZT-driving-pulse generating circuit 53. The PZT-driving-pulse generating circuit 53 generates a driving-pulse signal, which is amplified by the PZT driver circuit 54 and output to the head module 10.

The first circuit 40 includes the charging/deflecting-signal generating circuit 41 and a back electrode driver circuit 42. The charging/deflecting-signal generating circuit 41 includes a deflector-voltage generating portion 44 and a charging signal generating portion 43 including a first charging-voltage generator 43*a* and a second charging-voltage generator 43*b*. As will be described later the first charging-voltage generator 43*a* is for determining the voltage of the charging/deflecting signal at the time of when ink droplets are separated from the meniscus, and the second charging-voltage generator 43*b* is for determining the voltage of the charging/deflecting signal at the time of when ejected ink droplets are divided into a plural ink droplets. The deflector-voltage generating portion 44 is for determining a deflector voltage for deflecting charged ink droplets. The back electrode driver circuit 42 amplifies signals generated in the charging/deflecting-signal generating circuit 41 to a predetermined voltage and outputs the same as charging/deflecting signals to the back electrode 30.

Figure 2:
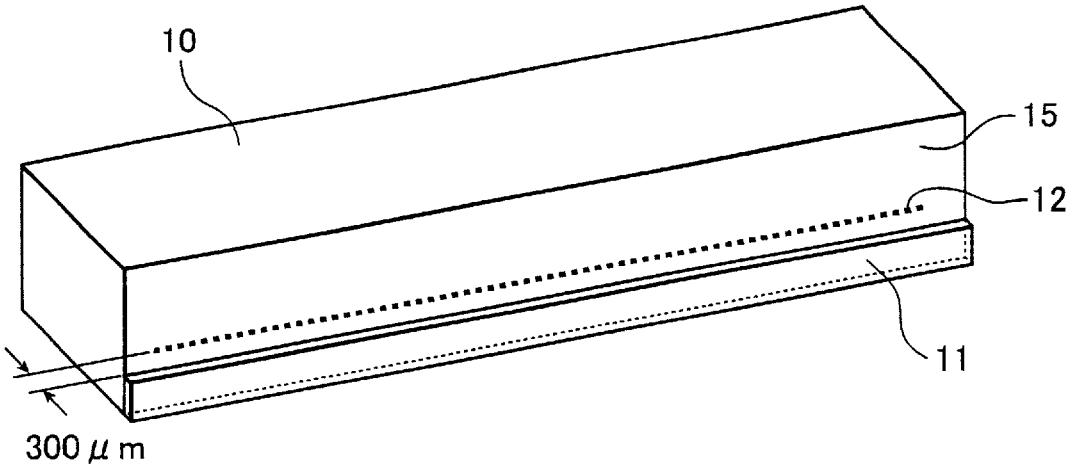
FIG. 2 is a perspective view of one of the head module of the inkjet printer of FIG. 1.

As shown in FIG. 2, each head module 10 includes an orifice plate 15 formed of an electrically conductive material, such as metal. The orifice plate 15 is formed with n nozzle holes 12 aligned at a predetermined pitch in a line. An orifice electrode 11 formed to a plate shape with a thickness of 0.5 mm is attached to the orifice plate 15 along the nozzle line of the nozzle holes 12 while keeping a distance of approximately 300 $\mu$m between the orifice plate 15 and the nozzle line. The orifice electrode 11 can be made from a material with electrical conductivity, such as a metal (stainless steel, nickel, or the like) or electrically conductive ceramics or resin.

The orifice electrode 11, the orifice plate 15, the back electrode 30, and the first circuit 40 together define the control device of the present embodiment. The control device serves as a charger/deflector device that charges and deflects an ink droplet so as to control the ink droplet to alight a target position on a recording medium in a manner described later.

Figure 3:
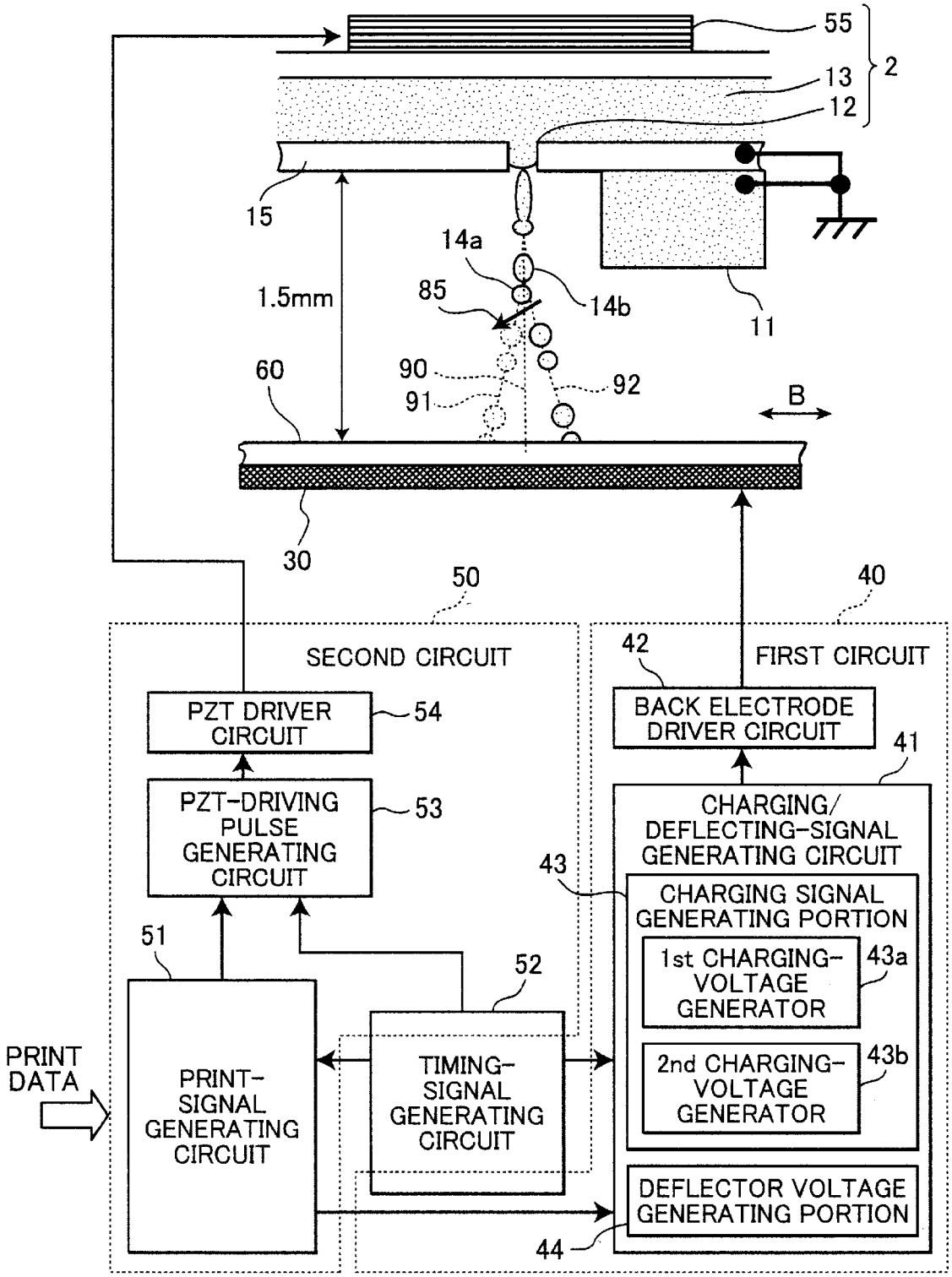
FIG. 3 is an explanatory view showing an ink deflection with the block diagram of FIG. 1.

A configuration of the head module 10 will be described in more detail. The head module 10 is an on-demand inkjet type linear print head module. As shown in FIG. 3, each head module 10 is formed from n nozzle elements 2 (only one is shown in FIG. 3). Each nozzle element 2 has the nozzle hole 12 formed in the orifice plate 15, a pressure chamber 13, and a piezoelectric element 55. The pressure chamber 13 is fluidly connected to the corresponding nozzle hole 12 and is filled with ink. The piezoelectric element 55 is provided to the pressure chamber 13 and serves as an actuator, to which the driving-pulse signal is applied from the second circuit 50. Although not shown in the drawings, the nozzle element 2 further includes an ink inlet port for introducing ink from a manifold to the pressure chamber 13.

When the driving-pulse signal is applied to the piezoelectric element 55, the piezoelectric element 55 changes the volume and thus the internal pressure of the pressure chamber 13 so that an ink droplet is ejected through the nozzle hole 12. For example, the nozzle hole 12 has a diameter of 40 $\mu$m, and approximately 20 ng ink droplet is ejected at the speed of 5 m/s toward the recording sheet 60 that is being fed in the direction A (FIG. 1) at a constant speed. Thus ejected ink droplet 14 will, if not deflected at all, travel straight to the recording sheet 60 along a center trajectory 90.

The back electrode 30 is formed to a flat-plate shape from an electrically conductive material, such as metal (stainless steel, nickel, or the like) or electrically conductive ceramics or resin. The back electrode 30 is placed in confrontation with the orifice plate 15 at a position 1.5 mm away from the surface of the orifice plate 15 to extend parallel to the surface of the orifice plate 15. The back electrode 30 has the potential corresponding to that of the charging/deflecting signal. In the present embodiment, the charging/deflecting signal in changed between −1 kV and +1 kV, and so the back electrode 30 is charged between −1 kV and +1 kV.

Figure 4:
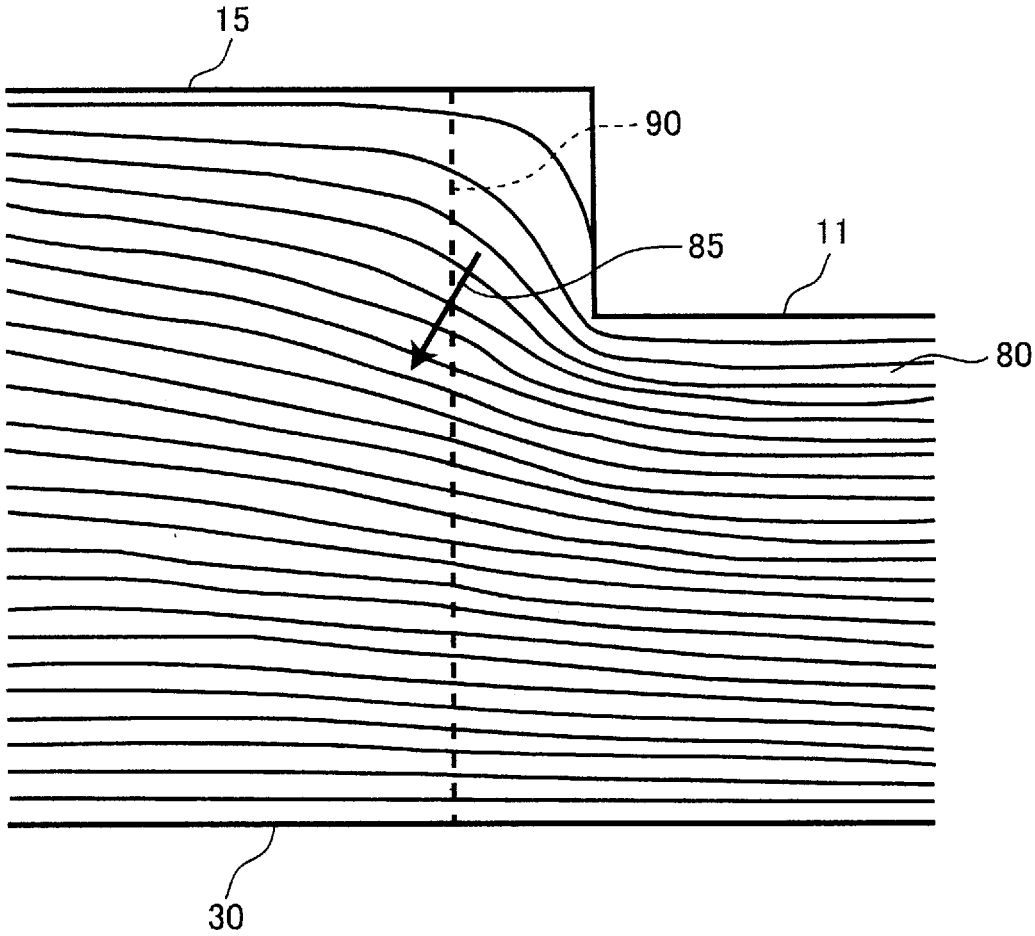
FIG. 4 shows an equipotential surface of an electric field generated by the control device.

The orifice electrode 11 as well as the orifice plate 15 and the ink filling in the nozzle elements 2 are electrically connected to the ground. Accordingly, when the back electrode 30 is applied with the charging/deflecting signal, an inclined electric field 85 is generated between the orifice electrode 11 and the pressure chamber 13 and the back electrode 30 as shown in FIG. 3. FIG. 4 shows an equipotential surface 80 of the inclined electric field 85. As shown, contour lines of the inclined electric field 85 are inclined near the center trajectory 90 with respect to the surface of the orifice plate 15. That is, the inclined electric field 85 includes a deflector field element in a direction perpendicular to the center trajectory 90.

In the configuration described above, an ink droplet to be ejected through the nozzle hole 12 is selectively charged positive or negative in accordance with the potential of the back electrode 30 at the time of ejection. As shown in FIG. 3, a positively charged ink droplet is deflected to the left by the electric field 85 and travels along a deflected trajectory 91, whereas a negatively charged ink droplet is deflected to the right by the electric field 85 and travels along a deflected trajectory 92.

Next, ink ejection in a single-droplet mode will be described while referring to FIG. 5. In FIG. 5(*b*), the piezoelectric element 55 is applied with a driving pulse signal B whose rising edge is located at timing T1. In response to the driving pulse signal B, an ink droplet 14 is ejected from the nozzle hole 12 and separates from the meniscus 16 at timing T2. The ink droplet 14 includes a main ink portion 14*m* and a satellite ink portion 14*s* following the main ink portion 14*m*. The ink droplets 14 flies toward the recording sheet 60, but is divided into a main ink droplet 14M and a satellite ink droplet 14S at timing T3 during the flight. However, the satellite ink droplet 14S soon catches up and merges with the main ink droplet 14M, so that a merged ink droplet 14*g* is generated and reaches the recording sheet as a single droplet.

Here, as shown in FIG. 5(*c*), first the charging/deflection signal is maintained at −1 kV by the deflector-voltage generating portion 44. However, the first charging-voltage generator 43*a* maintains the charging/deflection signal +1 kV around the timing T2. This +1 kV charging/deflection signal applied to the back electrode 30 congregates negative ions in ink near the meniscus 16. Accordingly, when the ink droplet 14 separates from the meniscus 16 at the timing T2, the negative ions are captured in the ejected ink droplet 14, so that the ink droplet 14 is negatively charged with a total charging amount of −9 q, for example (FIG. 5(*d*)). In the example shown in FIG. 5(*d*), the main ink portion 14*m* has a charging amount of −2 q, and the satellite ink portion 14*s* has a charging amount of −7 q (q is a constant).

Then, the charging/deflection signal is returned to 1 kV after the timing T2, so that the electric field 85 is generated as described above. The ink droplet 14 is divided with respect to a flying direction (vertical direction in this embodiment) into the main ink droplet 14M and the satellite ink droplet 14S at the timing T3, and the main ink droplet 14M and the satellite ink droplet 14S soon merge to form the ink droplet 14*g* with the charging amount of 9 q. The merged droplet 14*g* with the negative charge is deflected by the electric field 85 to fly along the deflected trajectory 92 and forms a single dot d1 on the recording sheet 60 at a target spot P as shown in FIG. 5(*e*). In this manner, the single-droplet mode is achieved.

Here, the deflection amount of the Ink droplet 14*g* depends on a relative charging amount that is a ratio between a charging amount Q and a mass M or the ink droplet 14*g*, i.e., Q/M.

However, in a conventional two-droplets mode, two separate droplets are deflected by different deflection amounts and impact the recording sheet 60 at different spots. As a result, an intended single dot is not recorded an the recording medium, but instead two undesired dots are formed as shown in FIG. 6(*e*). The reason for this will be described next while referring to FIGS. 6(*a*) to 6(*e*).

As shown in FIGS. 6(*a*) to 6(*d*), in a similar manner as in the above described single droplet mode, a negatively charged ink droplet 14 is ejected at the timing T2 in response to a driving pulse signal B and divided into a main ink droplet 14M and satellite ink droplet 14S as the timing T3. The ink droplet 14 has a charging amount of −9 q in total. However, unlike in the single-droplet mode, the main ink droplet 14M and the satellite ink droplet 14S do not merge during the flight, but reach the recording sheet 60 separately.

Here, as described above, the relative charging amount Q/M determines the deflecting amount of an ink droplet. Accordingly, the deflecting amount of the main ink droplet 14M is determined by a relative charging amount Qm/Mm, and the deflecting amount of the satellite ink droplet 14S is determined by a relative charging amount Qs/Ms. The charging amounts Qm and Qs of the main and satellite ink droplets 14M and 14S are in turn determined by the surface areas of the main ink portion 14*m* and the satellite ink portion 14*s* at the timing T2 and the charging/deflecting signal at the timing T3.

Specifically, the distribution of negative ions in the ink droplet 14 is determined by the surface area of the ink droplet 14. Accordingly, the main ink portion 14*m* has a charging amount of −2 q, whereas the satellite ink portion 14*s* that is larger in size than the main ink portion 14*m* has a charging amount of −7 q as shown in FIG. 6(*d*), for example. Then, the electric field 85 being generated at the timing T3 redistributes the negative ions within the ink droplet 14 with respect to the vertical direction, so that the negative ions are moved toward the satellite ink portion 14*s*. As a result, the charging amount of the main ink droplet 14M is decreased to −1 q, whereas the charging amount of the satellite ink droplet 14S increases to −8 q, for example. When the mass Qm of the main ink droplet 14M is 1 m (m is a constant) and the mass Qs of the satellite ink droplet 14S is 2 m, then the relative charging amount of the main ink droplet 14M is −4, and that of the satellite ink droplet 14S is −1, which is one quarter of the relative charging amount of the main ink droplet 14M. Hence, the deflection amount of the satellite ink droplet 14S is approximately four times the deflection amount of the main ink droplet 14M. Because of such a large difference between the deflection amounts, the main and satellite ink droplets 14M and 14S impact the recording sheet 60 at different spots as shown in FIG. 6(*e*).

According to the present embodiment, the above problem is overcome in the following manner Here, FIGS. 7(*a*), 7(*b*), 7(*c*), and 7(*c*') are the same views as the FIGS. 6(*a*), 6(*b*), 6(*c*), and 6(*d*) in order to facilitate the understandings.

Figures 7A, 7B, 7C, 7D, 7E, 7F:
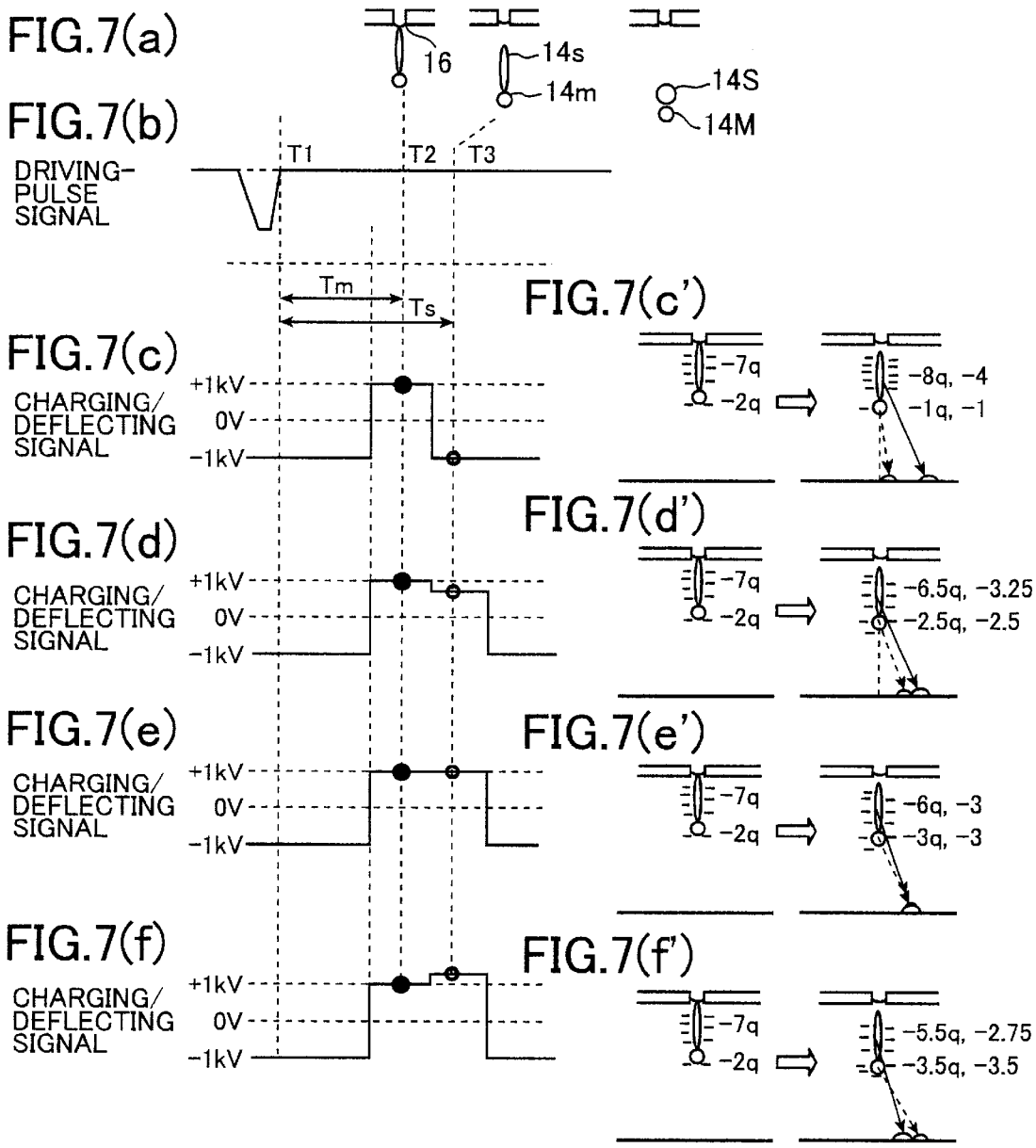
FIG. 7(*a*) is the same plan view as FIG. 6(*a*)

In a first example shown in FIG. 7(*d*), the voltage of the charging/deflecting signal at the timing T3 is set slightly lower than +1 kV that is the voltage at the timing T2. As a result of redistribution due to an electric field generated at the timing T3, the negative ions move toward the main ink portion 14*m*. Accordingly, the negative ions decrease in the satellite ink portion 14*s* and increase in the main ink portion 14*m*. The resultant main ink droplet 14M has the increased charging amount of, for example, −2.5 q, and the satellite ink droplet 14S has the decreased charging amount of −6.5 q as shown in FIG. 7(*d*). When the mass Qm of the main ink droplet 14M is 1 m, and when the mass Qs of the satellite ink droplet 14S is 2 m, then the relative charging amount of the main ink droplet 14M is −3.25, and the relative charging amount of the satellite ink droplet 14S is −2.5, which is two thirds of the relative charging amount of the main ink droplet 14M. Hence, the deflection amount of the satellite ink droplet 14S is closer to that of the main ink droplet 14M compared to the case shown in FIG. 7(*c*').

In a second example where the voltage of the charging/deflecting signal at the timing T3 is set to +1 kV as shown in FIG. 7(*e*), an electric field generated at the timing T3 redistributes and moves the negative ions to the main ink portion 14*m*. As shown in FIG. 7(*e*'), the resultant main ink droplet 14M has the increased charging amount of −3 q, and the satellite ink droplet 14S has the decreased charging amount of −6 q, for example. When the mass Qm of the main ink droplet 14M is 1 m and the mass Qs of the satellite ink droplet 14S is 2 m, then the relative charging amounts of the main ink droplet 14M and the satellite ink droplet 14S are both −3. Hence, the deflection amount of the satellite ink droplet 14S is approximately equal to the deflection amount of the main ink droplet 14M. Accordingly, the satellite ink droplet 14S and the main ink droplet 14M alight the recording sheet 60 on the same spot or on the extremely close spots, thereby forming a single dot.

In a third example where the voltage of the charging/deflecting signal at the timing T3 is set to slightly greater than +1 kV as shown in FIG. 7(*f*), the resultant main ink droplet 14M has the increased charging amount of −3.5 q, and the satellite ink droplet 14S has the decreased charging amount of −5.5 q, as shown in FIG. 7(*f*'). When the mass Qm is 1 m and the mass Qs is 2 m, then the relative charging amount of the main ink droplet 14M is −3.5, and the relative charging amount of the satellite ink droplet 14S is −2.75, which is smaller than that of the main ink droplet 14M.

As described above, according to the present embodiment, by controlling the voltage of the charging/deflecting signal at the timing T3, the main and satellite ink droplets 12M and 14S can have the same relative charging amount, so that the deflecting amounts of the main and satellite ink droplets 14M and 14S will be the same. Accordingly, it is possible to form a single dot even in the two-droplet mode.

Although there have been described for ejecting negatively charged ink droplet, the above is true for when ejecting positively charged ink droplet. That is, in FIG. 8(*a*), in response to a driving pulse B2, a positively charged ink droplet is ejected at timing T5 where the charging/deflecting signal is −1 kV. Then, the ink droplet is separated into a main ink droplet and a satellite ink droplet is the similar manner as a positively charged ink droplet.

Figures 8A, 8B, 8C, 8D, 8E:
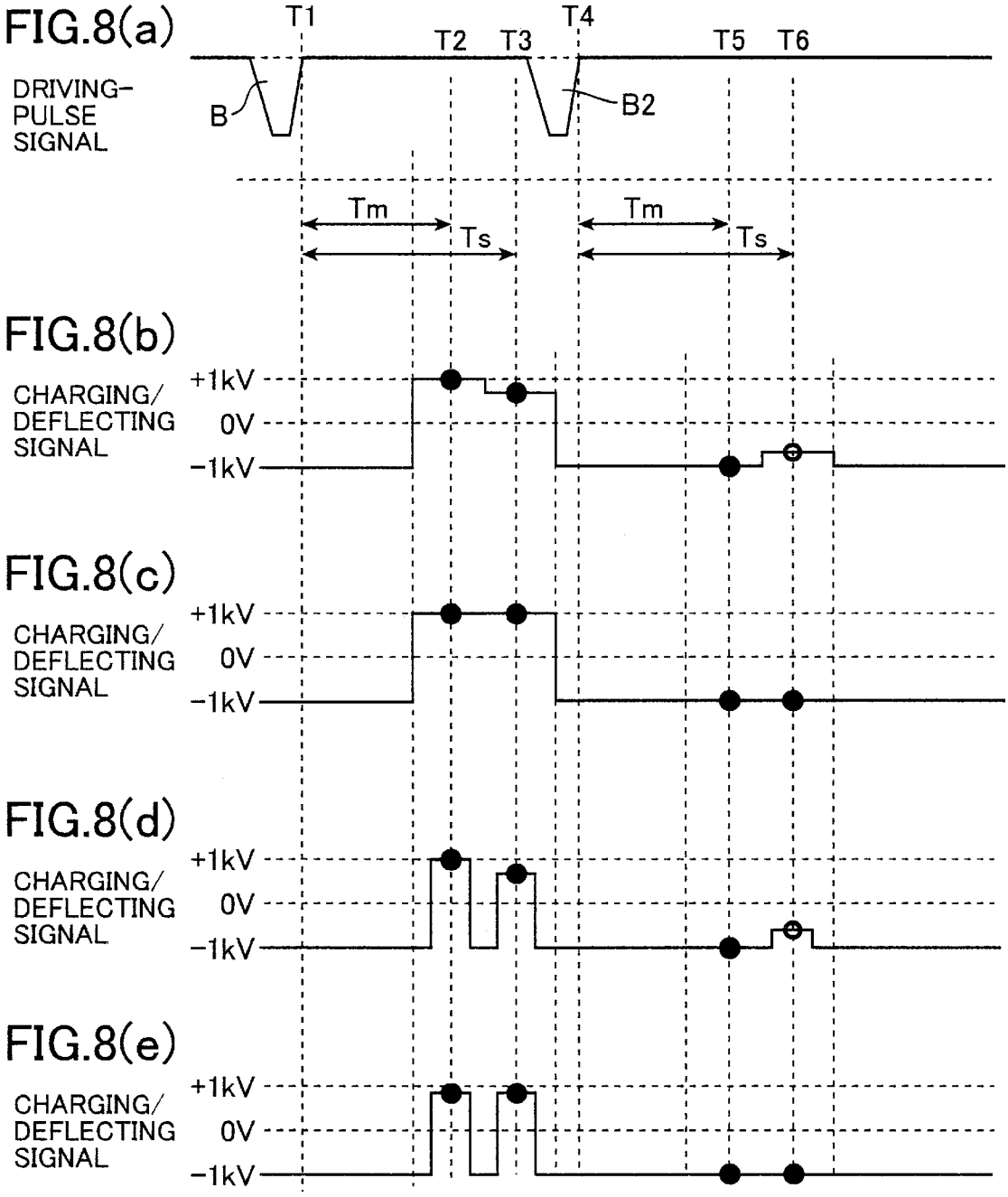
FIG. 8(*a*) shows a driving-pulse signal applied to the piezoelectric element.

In the first example shown in FIG. 8(*b*), the charging/deflecting signal is set slightly larger than −1 kV at the timing T6. In the second example shown in FIG. 8(*c*), the charging/deflecting signal is maintained at −1 kV at the timing T6. Redistributions occur within the positively charged ink droplets in accordance with the voltage of the charging/deflecting signal at the timing T6, so that a desirable single dot is formed on the recording sheet. It should be noted that the charging/deflecting signal is not limited to these examples, but should be adjusted to have an appropriate voltage in accordance with a charging voltage, a nozzle diameter, an ink ejection speed, a mass of an ink droplet, and the like.

FIGS. 8(*d*) and 8(*e*) show charging/deflecting signals according to modifications of the embodiment, wherein a pulse width of the charging/deflecting signal is shortened so that voltage of the charging/deflecting signal drops to −1 kV once between adjacent pulses. In these modification also the main and satellite ink droplets 14M, 14S are deflected by substantially the same amount to the same direction, and travel along the same trajectory to form a single dot.

According to the modifications, the time duration for applying the charging voltage of −1 kV to the back electrode 30 increases. This increases the deflection amount, so that the ink droplets are more effectively deflected. Here, the pulse width should be determined based on fluctuation during the operation in the time duration Tm and in the time duration Ts, unevenness in nozzle properties, and the like.

Figure 9:
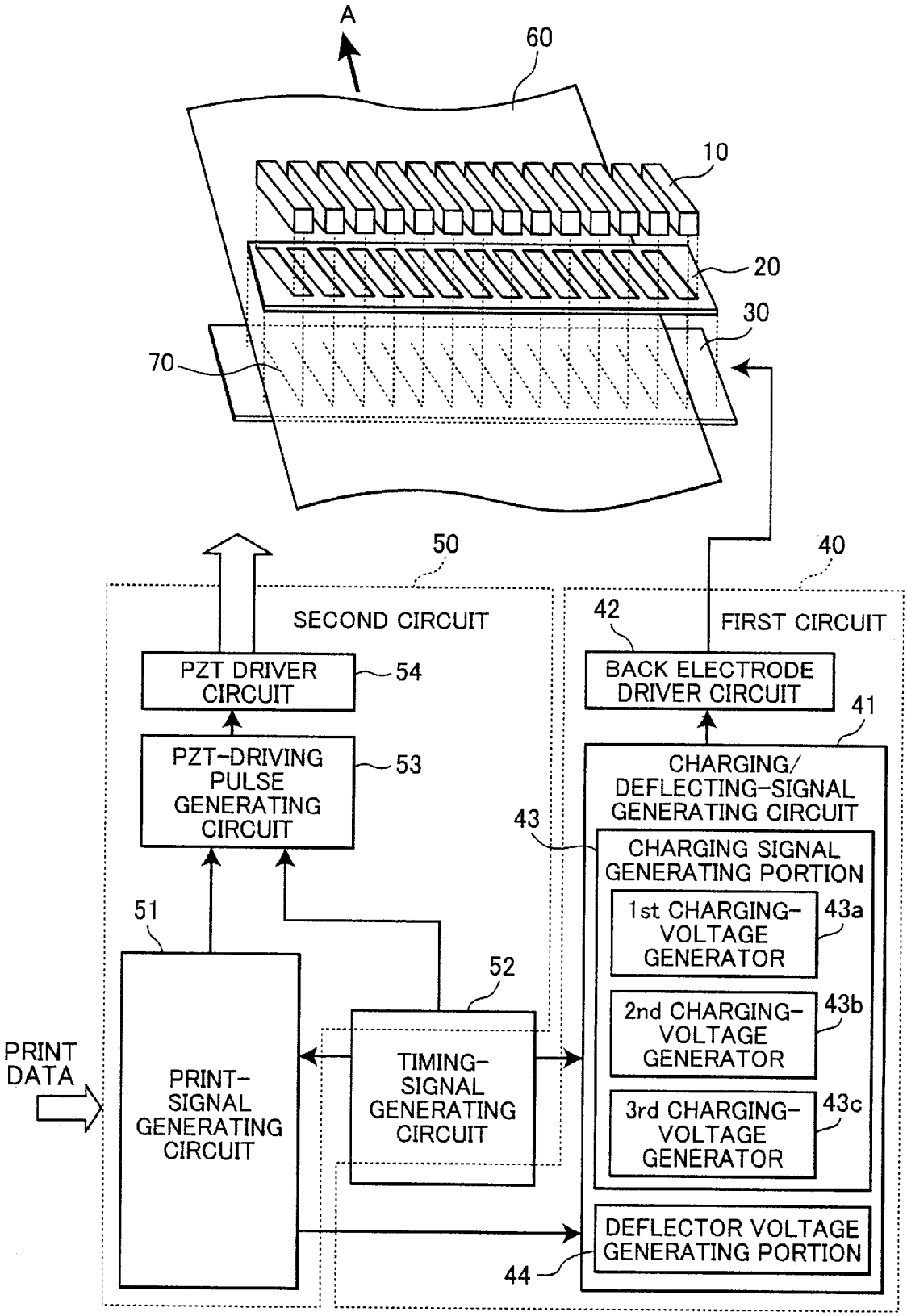
FIG. 9 is a plan view of main components, partially indicated in a block diagram, of an inkjet printer including a control device according to a second embodiment of the present invention.
Figure 10A:
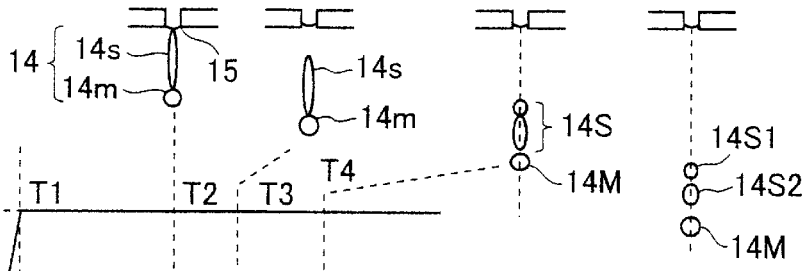
FIG. 10(*a*) is plan view of an ink droplet during flight according to a three-droplet mode.
Figure 10B:
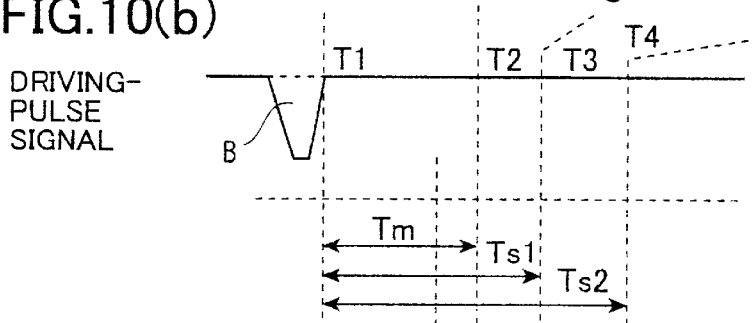
Figure 10C:
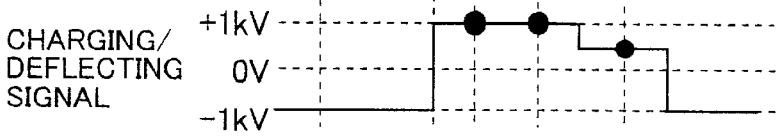

Next, an on-demand inkjet printer 100A including a control device according to a second embodiment of the present invention will be described while referring to FIGS. 9 and 10. As shown in FIG. 9, the inkjet printer 100A of the second embodiment has the similar configuration as the inkjet printer 100 of the first embodiment shown in FIG. 1, except the charging signal generating portion 43 includes a third-charging voltage generator 43*c*. In this embodiment, as shown in FIG. 10(*a*), after a single ink droplet 14 is divided into a main ink droplet 14M and a satellite ink droplet 14S, the satellite ink droplet 14S is further divided into a first sub-droplet 14S1 and a second sub-droplet 14S2. These three ink droplets 14M, 14S1, 14S2 are controlled to fly along the same trajectory to form a single dot on a recording sheet.

Specifically, the ink droplet 14 ejected at the timing T2 in response to the driving pulse B shown in FIG. 10(*b*) is divided into the main ink droplet 14M and the satellite ink droplet 14S at the timing T3. The voltage or the charging/deflecting signal at the timings T2 and T3 are controlled by the first and second charging-voltage generator 43*a*, 43*b*, respectively, of the first circuit 40 in the same manner as in the first embodiment. In addition, the third charging-voltage generator 43*c* controls the voltage of the charging/deflecting signal at timing T4 where the satellite ink droplet 14S is divided into the first and second sub-droplets 14S1 and 14S2. In this manner, the charging amount of the satellite ink droplet 14S is redistributed right before the separation at the timing T4. Accordingly, the relative charging amounts of the first and second sub-droplets 14S1 and 14S2 are controlled to be the same, whereby deflection amounts are controlled to be the same among the droplets 14M, 14S1, and 14S2, enabling roper recording operation.

As described above, the present invention is effective in a multi-droplet mode where an ejected ink droplet is divided two or more ink droplets during the flight.

Here, it has been confirmed through experiments that the appropriate charging amount after the redistribution control defers from the ink droplet generation conditions. That is, fluctuation in the ink or head properties will affect the separation or the ink droplet into plural ink droplets. Therefore, if a recording accuracy is regarded as important then a redistribution control can be adjusted regularly or in real time, especially when the machine is first turned ON, based on the ink properties fluctuated due to the ambient temperature or the like. On the other hand, if a recording accuracy is regarded as less important, then the margin can be set relatively large at the production by setting the pulse width wider or the like.

While some exemplary embodiments of this invention have been described in detail, those skilled in the art will recognize that there are many possible modifications and variations which may be made in these exemplary embodiments while yet retaining many of the novel features and advantages of the invention.

For example, although the above explanation has been provided for an on-demand type inkjet head, the present invention is also applicable in a continuous type inkjet head.

Also, the voltage of the charging/deflecting signal is set to change among −1 kV and +1 kV, this is not the limitation of the present invention, but the charging/deflecting signal could have different voltages.

What is claimed is:

1. A control device used in combination with an ejection unit that ejects and forms an ink droplet toward a recording medium, wherein the ink droplet formed by the ejection unit is divided into a plurality of sub-droplets during flight before reaching the recording medium, the control device comprising:

an electric field generating unit that generates a first electric field that redistributes charge within an ink droplet after the ink droplet was formed and before the ink droplet is divided into a plurality of sub-ink droplets, the first electric field redistributing the charge to cause the sub-droplets to have a same impact position.

2. The control device according to claim 1, wherein the electric field generating unit further generates a second electric field that deflects the plurality of sub-droplets by substantially the same deflection amount.

3. The control device according to claim 2, wherein each sub-droplet has a relative charging amount which is a ratio between a charging amount and a mass of the sub-droplet, the deflection amount of each sub-droplet is determined by a corresponding relative charging amount.

4. The control device according to claim 1, wherein each sub-droplet has a relative charging amount which is a ratio between a charging amount and a mass of the sub-droplet, and the first electric field redistributes the charge within the ink droplet such that the plurality of sub-droplets divided from the ink droplet have substantially the same relative charging amount.

5. The control device according to claim 1, wherein the electric field generating unit further generates a third electric field at the time of when the ejection unit ejects the ink droplet, the third electric field selectively charges the ink droplet.

6. The control device according to claim 1, wherein the ink droplet is divided in a first direction, and the first electric field redistributes the charge within the ink droplet with respect to the first direction.

7. The control device according to claim 1, wherein the electric field generating unit includes a nozzle plate formed with a nozzle through which the ejection unit ejects the ink droplet and a back electrode provided in confrontation with the nozzle plate with the recording medium interposed therebetween.

8. The control device according to claim 7, further comprising a control circuit that selectively generates and applies charging/deflecting signals to the back electrode, wherein the nozzle plate is grounded.

9. An inkjet printer comprising:

an ejection unit that ejects and forms an ink droplet toward a recording medium, wherein the ink droplet formed by the ejection unit is divided into a plurality of sub-droplets during flight before reaching the recording medium; and an electric field generating unit that generates a first electric field that redistributes charge within the ink droplet after the ink droplet was formed and before the ink droplet is divided, the first electric field redistributing the charge to cause the sub-droplets to have a same impact position.

10. The inkjet printer according to claim 9, wherein the electric field generating unit further generates a second electric field that deflects the plurality of sub-droplets by substantially the same deflection amount.

11. The inkjet printer according to claim 9, wherein each sub-droplet has a relative charging amount which is a ratio between a charging amount and a mass of the sub-droplet, the deflection amount of each sub-droplet is determined by a corresponding relative charging amount.

12. The inkjet printer according to claim 9, wherein each sub-droplet has a relative charging amount which is a ratio between a charging amount and a mass of the sub-droplet, and the first electric field redistributes the charge within the ink droplet such that the plurality of sub-droplets divided from the ink droplet have substantially the same relative charging amount.

13. The inkjet printer according to claim 9, wherein the electric field generating unit further generates a third electric field at the time of when the ejection unit ejects the ink droplet, the third electric field selectively charges the ink droplet.

14. The inkjet printer according to claim 9, wherein the ink droplet is divided in a first direction, and the first electric field redistributes the charge within the ink droplet with respect to the first direction.

15. The inkjet printer according to claim 9, wherein the electric field generating unit includes a nozzle plate formed with a nozzle through which the ejection unit ejects the ink droplet and a back electrode provided in confrontation with the nozzle plate with the recording medium interposed therebetween.

16. The inkjet printer according to claim 15, further comprising a control circuit that selectively generates and applies charging/deflecting signals to the back electrode, wherein the nozzle plate is grounded.

17. A control method of controlling impact position of sub-droplets, comprising the steps of:

a) forming an electrically charged ink droplet;

b) redistributing charge within the charged ink droplet before the charged ink droplet is divided into a plurality of sub-droplets; and c) deflecting the plurality of sub-droplets to cause the sub-droplets to have a same impact position.

18. The control method according to claim 17, wherein the charge within the charged ink droplet is redistributed in the step b) such that the plurality of sub-droplets have substantially the same relative charging amount that is a ratio between a charging amount of the sub-droplet and a mass of the sub-droplet.

19. The control method according to claim 18, wherein each of the sub-droplets is deflected in the step c) by a deflection amount that is determined by the relative charging amount of the sub-droplet.

* * * * *